US009954291B2

(12) United States Patent
Wang et al.

(10) Patent No.: US 9,954,291 B2
(45) Date of Patent: Apr. 24, 2018

(54) ELECTRICAL DEVICE HAVING REDUCED ARC TRACKING

(71) Applicant: TYCO ELECTRONICS CORPORATION, Berwyn, PA (US)

(72) Inventors: Lei Wang, San Jose, CA (US); Hyo Chang Yun, Saratoga, CA (US); Peter J. Dutton, Fremont, CA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/173,855

(22) Filed: Jun. 6, 2016

(65) Prior Publication Data

US 2017/0352966 A1 Dec. 7, 2017

(51) Int. Cl.
*H01R 9/24* (2006.01)

(52) U.S. Cl.
CPC ..... *H01R 9/2491* (2013.01)

(58) Field of Classification Search
CPC ..... H01R 12/52; H01R 43/16; H01R 12/675; H01R 13/639; H01R 13/71; H01R 13/7175; H01R 25/142; H01R 25/147; H01R 4/2416; H01R 4/2433; H01R 12/523; H01R 12/62; H01R 13/035; H01R 13/5205
See application file for complete search history.

(56) References Cited

U.S. PATENT DOCUMENTS 5,417,594 A * 5/1995 Herman ..... H01R 13/53 439/332
2011/0220638 A1* 9/2011 Wei ..... H05B 3/50 219/550
2012/0119868 A1* 5/2012 Shimadu ..... H01L 23/3677 336/200
2013/0040500 A1* 2/2013 Ngo ..... H01R 12/75 439/660
2013/0146937 A1 6/2013 Omura et al.
2014/0049983 A1* 2/2014 Nichol ..... G02B 6/0018 362/610
2014/0163664 A1* 6/2014 Goldsmith ..... A61B 17/00491 623/1.11
2014/0264944 A1* 9/2014 Otremba ..... H01L 23/28 257/777

FOREIGN PATENT DOCUMENTS

DE 19757938 A1 7/1999
DE 10142472 A1 10/2002
EP 1289075 A2 3/2003
WO WO-2009/012936 A1 1/2009

OTHER PUBLICATIONS

International Search Report for International Application No. PCT/US2017/035891, dated Aug. 9, 2017.

* cited by examiner

*Primary Examiner* — Truc Nguyen

(57) ABSTRACT

An electrical device includes first and second terminals and a terminal holder holding the first and second terminals. A first insulation layer is provided between the first and second terminals and a second insulation layer is provided between the first and second terminals. The first and second insulation layers are different materials. The first insulation layer is a base layer and the second insulation layer is a high arc tracking resistance rated layer on the base layer to discourage arc tracking on the first insulation layer.

19 Claims, 2 Drawing Sheets

ELECTRICAL DEVICE HAVING REDUCED ARC TRACKING

BACKGROUND OF THE INVENTION

The subject matter herein relates generally to electrical devices having reduced arc tracking.

Electrical devices are used in many applications, including power applications. In some applications, the electrical devices are subjected to environmental hazards. For example, in aeronautic, industrial or automotive applications, the electrical devices may be subjected to high temperatures. The housing or substrate of the electrical device, which holds the terminals, such as the power terminals, are manufactured from a high temperature rated material, such as a thermoplastic material. The housing is manufactured from a high relative thermal index (RTI) material. The housing needs to have sufficient mechanical strength to withstand the environmental conditions in which the electrical device is used.

The high temperature rated housings are not without disadvantages. For instance, in high voltage operating conditions, particularly under wet conditions, the electrical devices are susceptible to arc tracking. For example, carbonization occurs in an arc gap between high voltage terminals, leading to arcing between the terminals and failure of the housings.

A need remains for an electrical device having reduced arc tracking.

BRIEF SUMMARY OF THE INVENTION

In one embodiment, an electrical device is provided including first and second terminals and a terminal holder holding the first and second terminals. A first insulation layer is provided between the first and second terminals and a second insulation layer is provided between the first and second terminals. The first and second insulation layers are different materials. The first insulation layer is a high temperature rated layer. The second insulation layer is a high arc tracking resistance rated layer to discourage arc tracking on the first insulation layer.

In another embodiment, an electrical device is provided including a terminal holder and a plurality of terminals held by the terminal holder to define a terminal block. The plurality of terminals includes first and second terminals. A first insulation layer is either deposited on or defined by the terminal holder between the first and second terminals. A second insulation layer is deposited on the first insulation layer. The second insulation layer is provided between the first and second terminals. The first insulation layer is a high temperature rated layer and the second insulation layer is a high arc tracking resistance rated layer to discourage arc tracking on the first insulation layer.

In a further embodiment, a method is provided of reducing arc tracking on an electrical device including providing a first insulation layer between first and second terminals and providing a second insulation layer on the first insulation layer between the first and second terminals. The first insulation layer is a high temperature rated layer. The second insulation layer is a high arc tracking resistance rated layer to discourage arc tracking on the first insulation layer between the first and second terminals.

DETAILED DESCRIPTION OF SPECIFIC EMBODIMENTS OF THE INVENTION

Figure 1:
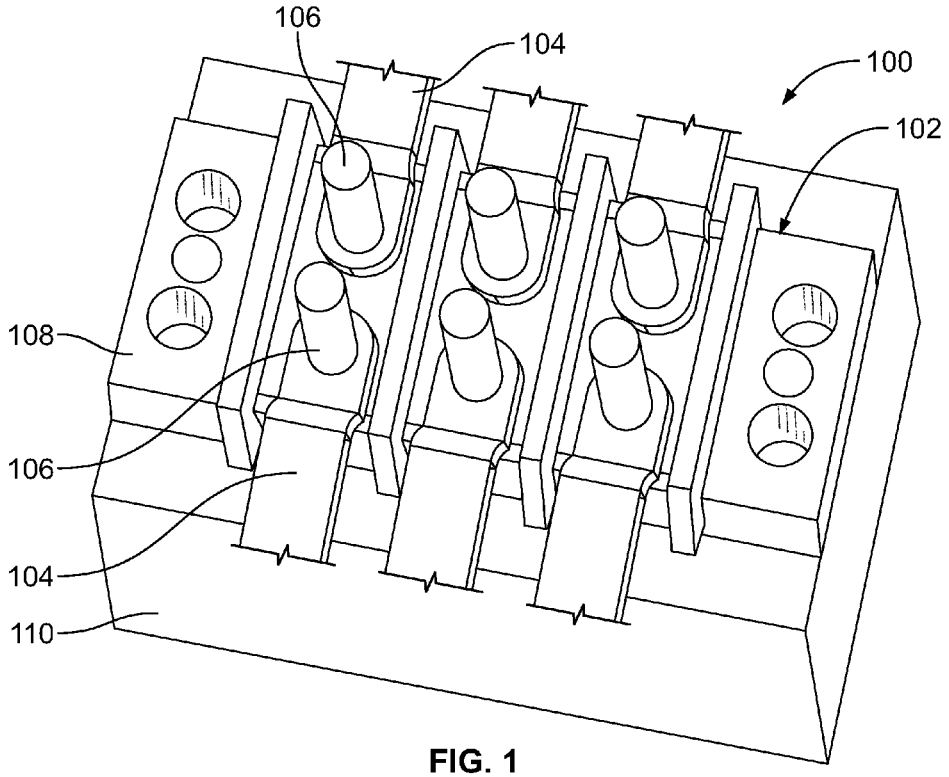
FIG. 1 is a perspective view of an electrical device formed in accordance with an exemplary embodiment.

FIG. 1 is a perspective view of an electrical device 100 formed in accordance with an exemplary embodiment. In the illustrated embodiment, the electrical device 100 includes a power terminal block 102 having a plurality of power cables 104 electrically connected to corresponding terminals 106 of the terminal block 102. The terminal block 102 may include any number of terminals 106 and corresponding power cables 104 terminated thereto. The terminals 106 are held by a terminal holder 108. Other types of electrical devices may be used in alternative embodiments and the electrical device 100 is not limited to a terminal block or a power connector. For example, in other embodiments, the electrical device 100 may be configured to be coupled to a corresponding mating connector. For example, the electrical device 100 may be a header connector or a receptacle connector.

The electrical device 100 may be used in various applications, including power applications. The electrical device 100 may be subjected to environmental hazards, such as high temperatures, wet conditions, and the like. The electrical device 100 may be used in aeronautic, industrial, automotive, or other applications. The electrical device 100 may be designed to withstand the environmental hazards. For example, the materials used for the electrical device 100 may have high mechanical strength, chemical resistance, high temperature resistance, high voltage resistance, and the like.

The electrical device 100 includes a substrate or housing 110 that may be formed, at least in part, by the terminal holder 108. For example, the terminal holder 108 may define the entire housing 110. Alternatively, the terminal holder 108 may be a part of the housing 110, such as a cover on the housing 110. In other various embodiments, the terminal holder 108 may be a component supported by the housing 110. The housing 110 may hold other components, such as electronics, circuit boards, terminal bus bars, a power source, and the like.

The terminal holder 108 is an insulating member used to hold and electrically isolate the terminals 106. The terminal holder 108 is formed from one or more insulating layers forming a rigid structure used to hold the terminals 106 and provide electrical isolation between the terminals 106. For example, the terminal holder 108 may be a laminated structure formed from layers having different materials and properties. In an exemplary embodiment, at least one of the insulation layers of the terminal holder 108 may be a high temperature rated layer capable of withstanding high temperatures. At least one of the insulation layers of the terminal holder 108 has a high mechanical strength capable of retaining shape and supporting other components and capable of withstanding high pulling forces and torque. At least one of the layers of the terminal holder 108 may be a high arc tracking resistance rated layer capable of withstanding high voltages. The high arc tracking resistance rated layer(s) discourage arc tracking on the high temperature rated layer(s) by breaking continuity of carbon arc tracking paths. Other layers may be provided in addition to the high temperature rated layer(s) and high arc tracking resistance rated layer(s), such as an adhesive layer between the high temperature rated layer and the high arc tracking resistance rated layer. Other insulation layers may be provided in addition to the high temperature rated layer and the high arc tracking resistance rated layer, such as a base layer, which may form part of the housing 110.

Figure 2:
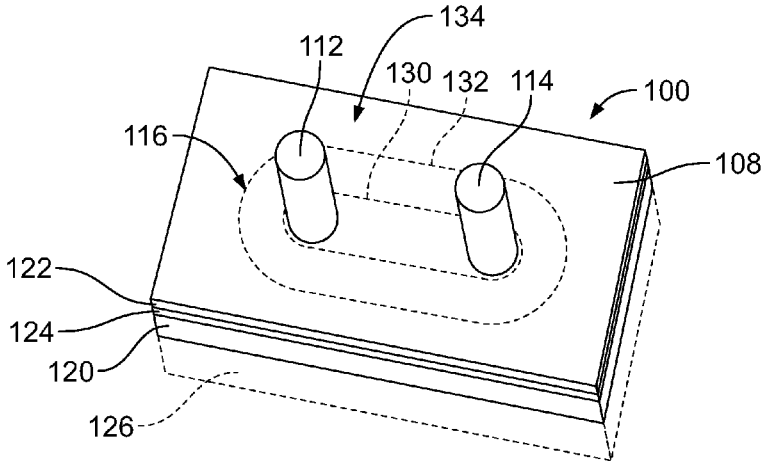
FIG. 2 is a schematic illustration of a portion of the electrical device in accordance with an exemplary embodiment.

FIG. 2 is a schematic illustration of a portion of the electrical device 100. The electrical device 100 includes the terminal holder 108 holding a plurality of the terminals 106. In the illustrated embodiment, the terminal holder 108 holds a first terminal 112 and a second terminal 114; however any number of terminals may be provided in various embodiments. The terminal holder 108 and the terminals 112, 114 may be part of a power terminal block, such as the power terminal block 102 (shown in FIG. 1). The first and second terminals 112, 114 are provided in a terminal area 116 of the terminal holder 108. Optionally, the terminal holder 108 may include multiple terminal areas 116.

The first and second terminals 112, 114 may be electrically connected together or may be part of different circuits. In an exemplary embodiment, the first and second terminals 112, 114 are power terminals. Optionally, the first and second terminals 112, 114 may be high voltage power terminals, such as terminals configured to carry 100 volts or more. For example, various embodiments of the terminals 112, 114 may be configured to carry 120 volts, 300 volts, 600 volts, or more. In the illustrated embodiment, the first and second terminals 112, 114 are terminal posts extending from the terminal holder 108 configured to receive power cable lugs, such as ring lugs, fork lugs or other types of power terminal connectors. The terminal posts may be threaded. The power cable lugs may be secured to the terminal posts by nuts or other types of fasteners or securing means. Other types of terminals may be provided in various embodiments, such as blades, weld tabs, pins, sockets, and the like.

The terminal holder 108 includes a plurality of insulation layers for holding the terminals 112, 114. The terminal holder 108 includes a first insulation layer 120 and a second insulation layer 122 on the first insulation layer 120. The first insulation layer 120 is either deposited on or defined by the terminal holder 108 (for example, the first insulation layer 120 may be a layer of the terminal holder 108). The first insulation layer 120 may be provided between the first and second terminals 112, 114. The first insulation layer 120 defines a base layer or substrate for the second insulation layer 122 and may be referred to hereinafter as a base layer 120.

The second insulation layer 122 may be deposited on the first insulation layer 120. For example, the second insulation layer 122 may be laminated to the first insulation layer 120 using an adhesive layer 124 or may be deposited thereon by other means. The second insulation layer 122 may be entirely above the first insulation layer 120 or may be at least partially recessed into the first insulation layer 120 (for example, with a portion of the second insulation layer 122 above the outer surface of the first insulation layer 120 and a portion of the second insulation layer 122 below the outer surface of the first insulation layer 120, such as in a pocket, channel or recess). Optionally, the outer surface of the second insulation layer 122 may be flush with the outer surface of the first insulation layer 120. Optionally, the terminal holder 108 may include other insulation layers, such as a third insulation layer 126 (shown in phantom) that may serve as a base or substrate below the first insulation layer 120. In an exemplary embodiment, the second insulation layer 122 is exterior of the first insulation layer 120.

The first and second insulation layers 120, 122 are manufactured from different materials having different characteristics. For example, in an exemplary embodiment, the first insulation layer 120 is a high temperature rated layer having a high mechanical strength. The first insulation layer 120 is used to provide mechanical stability, stiffness, and is capable of meeting operating temperature requirements of the electrical device 100. The first insulation layer 120 has good stretch, torque or other force resistance to provide the mechanical stability for the terminal holder 108. The first insulation layer 120 has sufficient thickness to provide the mechanical stability and stiffness for the particular application of the electrical device 100. The first insulation layer 120 may be significantly thicker than the second insulation layer 122 making up a majority of the thickness of the terminal holder 108.

The second insulation layer 122 is a high arc tracking resistance rated layer having a higher arc tracking resistance than the first insulation layer 120. In this application, "high arc tracking resistance rated layer" means having a comparative tracking index, as defined below, of at least 400V. The second insulation layer 122 is used to discourage arc tracking on the first insulation layer 120 during high voltage operating conditions. For example, the high arc tracking resistance characteristic of the second insulation layer 122 as compared to the first insulation layer 120 may break the continuity of a carbon arc tracking path otherwise formed on the terminal holder 108 during high voltage operating conditions by either fully or partially covering the surface with the second insulation layer 122. Using multiple layers 120, 122 provides a structure having a high temperature rating, high mechanical strength and a high arc tracking resistance for use in harsh environments. Providing the second insulation layer 122, having the higher arc tracking resistance, results in a reduction in arcing over a similar structure (e.g., terminal holder) with only the first insulation layer or with only materials having relatively low arc tracking resistance (e.g., having a comparative tracking index of below 250V), In use, the terminal holder 108 is subjected to high temperatures. For example, the operating environment may have high temperatures. The terminals 112, 114 may carry high power and thus have a high temperature due to the high current and/or high voltage passing through the terminals. The heat from the terminals 112, 114 may heat the terminal holder 108. To withstand the high temperatures without damaging the terminal holder 108, the terminal holder 108 is manufactured from a material having a high temperature rating. For example, the first insulation layer 120 may be manufactured from an insulating material having a high relative thermal index (RTI) as measured per UL746B, i.e. a material capable of withstanding temperatures of 150° C. or more, such as above 200° C., 250° C., or more. The first insulation layer 120 may have sufficient strength to withstand high pulling forces and torque for maintaining shape and supporting other components. For example, the first insulation layer 120 may have a strength to weight ratio of greater than approximately 40 kN-m/k, the first insulation layer 120 may have a tensile strength of greater than 50

MPa. For example, the first insulation layer 120 may be an engineered thermoplastic with a density of 1.3 g/cm3 and tensile strength of 50 MPa with a strength to weight ratio of approximately 38 KN-m/Kg. The first insulation layer 120 may have a compressive strength of greater than 50 MPa. The first insulation layer 120 may be a thermoplastic material. The first insulation layer 120 may be a composite material. The first insulation layer 120 may include materials (including blends of) such as, but not limited to, polyamide (PA), polyphenylenesulfide (PPS), polyimide derivatives such as polyetherimide (PEI), polyaryletherketone derivatives such as polyetheretherketone (PEEK), polysulfone derivatives such as polyethersulfone (PES), and combinations thereof, or other thermoplastic materials having a high temperature rating. The first insulation layer 120 may be a reinforced layer, such as a glass fiber reinforced layer. The first insulation layer 120 may have an aromatic chemical structure providing a material with high RTI insulation properties. The first insulation layer 120 may be a polymer blend material, such as a glass fiber reinforced thermoplastic.

However, materials of the first insulation layer 120 having high RTI and high mechanical strength tend to have insufficient comparative tracking index (CTI) insulation characteristics for certain applications, such as high voltage applications, particularly in wet conditions, to which the terminal holder 108 may be subjected in certain applications. RTI is the maximum service temperature for a material where specific properties are not unacceptably compromised. CTI, as described in UL746A and ASTM D3638-12, is used to measure the electrical breakdown (tracking) properties of an insulating material. Tracking is an electrical breakdown on the surface of an insulating material. For example, at high voltage, materials may gradually create a conductive leakage path across the surface of the material by forming a carbonized track, which causes arcing between the terminals 112, 114 along the carbonized track. Because mechanical strength and CTI of materials are generally inversely related, selecting a material having a high mechanical strength tends to have a low CTI making such material susceptible to tracking, which may lead to arcing in some conditions (for example, high voltage and/or wet conditions). Because RTI and CTI of materials are generally inversely related, selecting a material having a high mechanical strength tends to have a low CTI making such material susceptible to tracking, which may lead to arcing in some conditions (for example, high voltage and/or wet conditions). However, some materials, such as fluoropolymers, may have good RTI and good CTI but lack mechanical strength.

To prevent damage to the terminal holder 108 and the first insulation layer 120, the second insulation layer 122 is provided on the first insulation layer 120 in an appropriate area, such as in an area between the terminals 112, 114 where arcing tends to occur. The second insulation layer 122 is manufactured from an insulation material having a high CTI. The second insulation layer 122 may be manufactured from an insulation material having a tracking index of approximately 400V or more. The second insulation layer 122 discourages arc tracking on the first insulation layer 120. The second insulation layer 122 is arranged in the arc tracking path, such as between the terminals 112, 114, to create an interruption in the arc path to reduce the risk of arcing between the terminals 112, 114. The second insulation layer 122 may break the continuity of the carbon arc tracking path otherwise formed on the second insulation layer 122 during high voltage operating conditions by either fully or partially covering the surface of the second insulation layer 122. The second insulation layer 122 may be manufactured from a material having a CTI above 600V; however, the second insulation layer 122 may be manufactured from a material having a lower rating level depending on the particular application and the voltage requirements of the electrical device 100. Because mechanical strength and CTI of materials are generally inversely related, selecting a material having a high CTI tends to have a low mechanical strength making such material inappropriate from being the base or substrate layer for the terminal holder as such material is susceptible to breaking. The second insulation layer 122 may include a fluoropolymer material or a fluoropolymer and thermoplastic blend, such as, but not limited to, (including blends of) perfluoroalkoxy (PFA), fluorinated ethylene propylene (FEP), polytetrafluoroethylene (PTFE), or a combination thereof and/or composites materials including such materials. The second insulation layer 122 may be a reinforced layer, such as a glass fiber reinforced layer. For example, the second insulation layer 122 may be a glass filled nylon 66 material having good CTI and good mechanical strength. The second insulation layer 122 may have a non-aromatic chemical structure providing a material with high CTI insulation properties. However, materials of the second insulation layer 122 having high CTI insulation characteristics tend to lack sufficient stiffness and mechanical strength for the terminal holder 108. The combination of the first insulation layer 120 to provide the mechanical strength and temperature requirements and the second insulation layer 122 to provide the arc tracking resistance provides a structure for the terminal holder 108.

The first insulation layer 120 is provided in the terminal area 116, which is the area of the terminal holder 108 immediately surrounding the terminals 112, 114. The terminal area 116 includes an intermediate area 130, which is the region directly between the terminals 112, 114 and having the highest risk of arc tracking or carbonization track, and a buffer area 132 around the terminals 112, 114 and intermediate area 130 and having a lower risk of arc tracking than the intermediate area 130. An outer area 134 surrounds the terminal area 116 and has little to no risk of arc tracking. In an exemplary embodiment, the first insulation layer 120 covers the entire intermediate area 130. The first insulation layer 120 may cover the entire buffer area 132. The first insulation layer 120 may cover a portion of, or the entire, outer area 134 of the terminal holder 108. In an exemplary embodiment, the second insulation layer 122 is provided on the first insulation layer 120 between the terminals 112, 114. Optionally, the second insulation layer 122 may cover the entire intermediate area 130. The second insulation layer 122 may cover the entire buffer area 132. The second insulation layer 122 may cover a portion of, or the entire, outer area 134 of the terminal holder 108. In the illustrated embodiment, the first and second insulation layers 120, 122 cover the entire terminal area 116 and at least a portion of the outer area 134.

Figure 3:
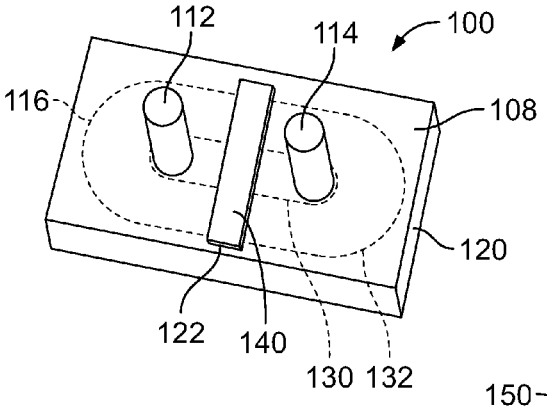
FIG. 3 is a schematic illustration of a portion of the electrical device in accordance with an exemplary embodiment.

FIG. 3 is a schematic illustration of a portion of the electrical device 100. The electrical device 100 includes the terminal holder 108 holding the first and second terminals 112, 114 in the terminal area 116. Any number of terminals may be provided in various embodiments. The terminal holder 108 includes the first insulation layer 120 and the second insulation layer 122 on the first insulation layer 120. The second insulation layer 122 may be laminated to the first insulation layer 120.

The first and second insulation layers 120, 122 are manufactured from different materials having different characteristics. For example, in an exemplary embodiment, the first insulation layer 120 is a high temperature rated layer (for example, a high RTI insulation layer). The first insulation layer 120 may have an RTI of approximately 150° C. or above. The second insulation layer 122 is a high arc tracking resistance rated layer having a higher arc tracking resistance than the first insulation layer 120. The second insulation layer 122 may have a CTI greater than 400V. The second insulation layer 122 may have an RTI of approximately 150° C. or above. In various embodiments, the first insulation layer 120 may have a higher RTI than the second insulation layer 122. The first insulation layer 120 is used to provide mechanical stability, stiffness, and is capable of meeting operating temperature requirements of the electrical device 100. The second insulation layer 122 is used to discourage arc tracking on the first insulation layer 120 during high voltage operating conditions by interrupting carbonization paths on the terminal holder 108.

The first insulation layer 120 is provided in the terminal area 116, such as in the intermediate area 130 and the buffer area 132. In an exemplary embodiment, the first insulation layer 120 covers the entire intermediate area 130 and the entire buffer area 132. In an exemplary embodiment, the second insulation layer 122 is provided on the first insulation layer 120 between the terminals 112, 114 as a strip 140. The strip 140 is oriented perpendicular to the axis between the terminals 112, 114 and spans entirely across the intermediate area 130. The strip 140 covers a portion of the buffer area 132; however the strip 140 may be limited to the intermediate area 130 in alternative embodiments. Portions of the first insulation layer 120 in the intermediate area 130 are exposed on both sides of the strip 140, such as between the strip 140 and the first terminal 112 and between the strip 140 and the second terminal 114. The strip 140 interrupts the carbonization path to discourage arc tracking between the terminals 112, 114.

Figure 4:
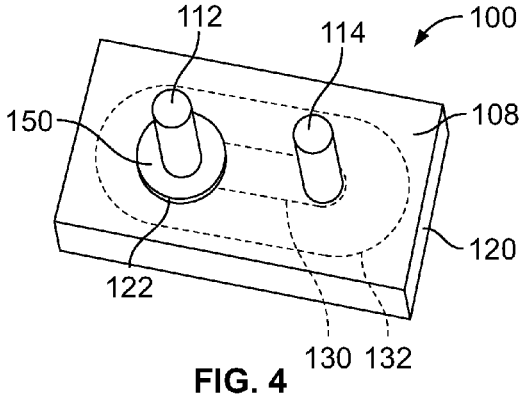
FIG. 4 is a schematic illustration of a portion of the electrical device in accordance with an exemplary embodiment.

FIG. 4 is a schematic illustration of a portion of the electrical device 100. The electrical device 100 includes the terminal holder 108 holding the first and second terminals 112, 114 in the terminal area 116. Any number of terminals may be provided in various embodiments. The terminal holder 108 includes the first insulation layer 120 and the second insulation layer 122 on the first insulation layer 120. The second insulation layer 122 may be laminated to the first insulation layer 120.

The first and second insulation layers 120, 122 are manufactured from different materials having different characteristics. For example, in an exemplary embodiment, the first insulation layer 120 is a high temperature rated layer (for example, a high RTI insulation layer) having high mechanical strength as compared to the second insulation layer 122. The second insulation layer 122 is a high arc tracking resistance rated layer having a higher arc tracking resistance than the first insulation layer 120. The first insulation layer 120 is used to provide mechanical stability, stiffness, and is capable of meeting operating temperature requirements of the electrical device 100. The second insulation layer 122 is used to discourage arc tracking on the first insulation layer 120 during high voltage operating conditions.

The first insulation layer 120 is provided in the terminal area 116, such as in the intermediate area 130 and the buffer area 132. In an exemplary embodiment, the first insulation layer 120 covers the entire intermediate area 130 and the entire buffer area 132. In an exemplary embodiment, the second insulation layer 122 is provided on the first insulation layer 120 between the terminals 112, 114 as a pad 150. The pad 150 surrounds the first terminal 112; however the pad 150 may additionally or alternatively surround the second terminal 114. The pad may extend only partially around the terminal 112 in other embodiments (for example, C-shaped). The pad 150 covers a portion of the intermediate area 130 and may cover a portion of the buffer area 132. Portions of the first insulation layer 120 in the intermediate area 130 are exposed between the pad 150 and the second terminal 114. The pad 150 interrupts the carbonization path to discourage arc tracking between the terminals 112, 114.

Figure 5:
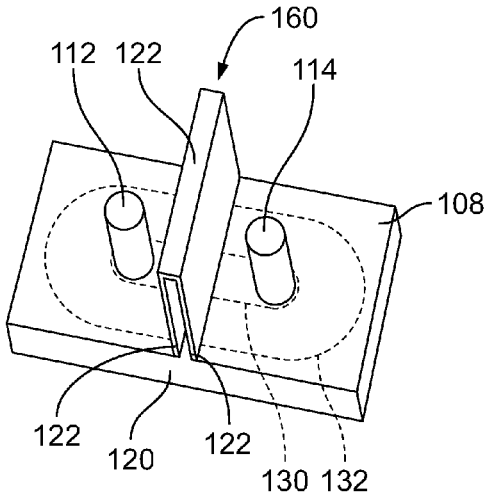
FIG. 5 is a schematic illustration of a portion of the electrical device in accordance with an exemplary embodiment.

FIG. 5 is a schematic illustration of a portion of the electrical device 100. The electrical device 100 includes the terminal holder 108 holding the first and second terminals 112, 114 in the terminal area 116. In the illustrated embodiment, the terminal holder 108 includes a barrier wall 160 between the terminals 112, 114. The barrier wall 160 is oriented perpendicular to the axis between the terminals 112, 114 and spans entirely across the intermediate area 130. The barrier wall 160 may be as tall as or taller than the terminals 112, 114; however the barrier wall 160 may be shorter than the terminals 112, 114 in other embodiments. Any number of terminals may be provided in various embodiments and of which may have barrier walls therebetween. The terminal holder 108 includes the first insulation layer 120 and the second insulation layer 122 on the first insulation layer 120. The second insulation layer 122 may be laminated to the first insulation layer 120.

The first and second insulation layers 120, 122 are manufactured from different materials having different characteristics. For example, in an exemplary embodiment, the first insulation layer 120 is a high temperature rated layer (for example, a high RTI insulation layer) having high mechanical strength as compared to the second insulation layer 122. The second insulation layer 122 is a high arc tracking resistance rated layer having a higher arc tracking resistance than the first insulation layer 120. The first insulation layer 120 is used to provide mechanical stability, stiffness, and is capable of meeting operating temperature requirements of the electrical device 100. The second insulation layer 122 is used to discourage arc tracking on the first insulation layer 120 during high voltage operating conditions.

The first insulation layer 120 is provided in the terminal area 116, such as in the intermediate area 130 and the buffer area 132. In an exemplary embodiment, the first insulation layer 120 covers the entire intermediate area 130 and the entire buffer area 132. Optionally, the barrier wall 160 may be at least partially defined by the first insulation layer 120. In an exemplary embodiment, the second insulation layer 122 is provided on the first insulation layer 120 between the terminals 112, 114. In an exemplary embodiment, the second insulation layer 122 is provided on the barrier wall 160. Optionally, the second insulation layer 122 may cover the top edge of the barrier wall 160. The second insulation layer 122 may cover the side walls of the barrier wall 160. The second insulation layer 122 may be provided around the barrier wall 160, such as between the barrier wall 160 and the first terminal 112 and between the barrier wall 160 and the second terminal 114. The barrier wall 160 and the second insulation layer 122 interrupt the carbonization path to discourage arc tracking between the terminals 112, 114.

Figure 6:
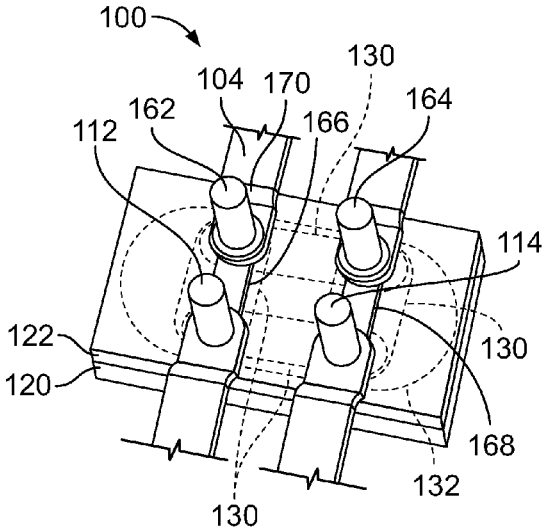
FIG. 6 is a schematic illustration of a portion of the electrical device in accordance with an exemplary embodiment.

FIG. 6 is a schematic illustration of a portion of the electrical device 100. The electrical device 100 includes the terminal holder 108 holding the first and second terminals 112, 114 as well as third and fourth terminals 162, 164 in the terminal area 116. In the illustrated embodiment, a first bus bar 166 electrically connects the first and third terminals 112, 162 and a second bus bar 168 electrically connects the second and fourth terminals 114, 164. The first and second bus bars 166, 168 are provided in the terminal area 116, such as spanning along intermediate areas 130 between the corresponding first and third terminals 112, 162 and second and fourth terminals 114, 164, respectively. Optionally, the buffer area 132 may be provided between the first and second bus bars 166, 168. Optionally a barrier wall (not shown) may be provided in the space between the bus bars 166, 168.

Power cables 104 are terminated to each of the terminals 112, 114, 162, 164. For example, power cable lugs 170 are provided at ends of the power cables 104, such as being crimped, welded or otherwise mechanically and electrically provided at the ends of the power cables 104. The power cable lugs 170 include ring terminals received on the terminals 112, 114, 162, 164 and secured thereto by nuts 172; however other types of lugs or connectors may be provided to electrically connect the power cables 104 to the terminals 112, 114, 162, 164.

The terminal holder 108 includes the first insulation layer 120 and the second insulation layer 122 on the first insulation layer 120. The second insulation layer 122 may be laminated to the first insulation layer 120. The first and second insulation layers 120, 122 are manufactured from different materials having different characteristics. For example, in an exemplary embodiment, the first insulation layer 120 is a high temperature rated layer (for example, a high RTI insulation layer) having high mechanical strength as compared to the second insulation layer 122. The second insulation layer 122 is a high arc tracking resistance rated layer having a higher arc tracking resistance than the first insulation layer 120. The first insulation layer 120 is used to provide mechanical stability, stiffness, and is capable of meeting operating temperature requirements of the electrical device 100. The second insulation layer 122 is used to discourage arc tracking on the first insulation layer 120 during high voltage operating conditions.

The first insulation layer 120 is provided in the terminal area 116, such as in the intermediate area(s) 130 and the buffer area(s) 132. In an exemplary embodiment, the first insulation layer 120 covers the entire intermediate areas 130 and the entire buffer area 132. In an exemplary embodiment, the second insulation layer 122 is provided on the first insulation layer 120 between the terminals 112, 114, 162, 164. In an exemplary embodiment, the second insulation layer 122 is provided below the bus bars 166, 168. The second insulation layer 122 is provided between the bus bars 166, 168. The second insulation layer 122 interrupts the carbonization path between and around the bus bars 166, 168 to discourage arc tracking between the bus bars 166, 168 and the terminals 112, 114, 162, 164.

Various embodiments described herein provide a high arc tracking resistance rated insulation layer (for example, a high CTI material layer) on a more robust high temperature rated insulation layer (for example, a high RTI material layer). The high arc tracking resistance rated layer prevents arcing on the high temperature rated layer between the terminals 112, 114 by providing the high CTI material in the arc tracking path. The high arc tracking resistance rated layer may be selectively placed on the substrate layer having high mechanical strength, such as in the carbonization path most susceptible to arc tracking. As such, the amount of high arc tracking resistance rated material needed may be reduced, which may simplify manufacture and/or reduce cost. A method of reducing arc tracking on an electrical device includes providing the first insulation layer 120 between first and second terminals 112, 114 and providing a second insulation layer 122 on the first insulation layer 120 between the first and second terminals 112, 114. The first insulation layer 120 is a high temperature rated layer having high mechanical strength as compared to the second insulation layer 122. The second insulation layer 122 is a high arc tracking resistance rated layer to discourage arc tracking on the first insulation layer between the first and second terminals.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical device comprising:

first and second terminals;

a terminal holder holding the first and second terminals;

a first insulation layer between the first and second terminals; and a second insulation layer between the first and second terminals;

wherein the first and second insulation layers are different materials, the first insulating layer comprising a polymer having an aromatic chemical structure and the second insulation layer comprising a fluoropolymer, the first insulation layer being a base layer and the second insulation layer being a high arc tracking resistance rated layer provided on the base layer to discourage arc tracking on the first insulation layer.

2. The electrical device of claim 1, wherein the second insulation layer is a high comparative tracking index (CTI) insulation material.

3. The electrical device of claim 1, wherein the first and second insulation layers define at least a portion of the terminal holder.

4. The electrical device of claim 1, wherein the second insulation layer is laminated to the first insulation layer using an adhesive layer.

5. The electrical device of claim 1, wherein the terminal holder includes a terminal area, the first and second terminals being provided in the terminal area, the first insulation layer covering the terminal area, the second insulation layer covering the first insulation layer at the terminal area.

6. The electrical device of claim 5, wherein the second insulation layer entirely covers the first insulation layer in the terminal area.

7. The electrical device of claim 1, wherein the terminal holder includes an intermediate area between the first and second terminals, the first insulation layer being provided at the intermediate area, the second insulation layer being provided at the intermediate area.

8. The electrical device of claim 7, wherein the second insulation layer is a strip on the first insulation layer positioned in the intermediate area between the first and second terminals.

9. The electrical device of claim 7, wherein the second intermediate layer is a pad surrounding at least one of the first and second terminals at least partially covering the intermediate area.

10. The electrical device of claim 7, wherein at least a portion of the first insulation layer is exposed in the intermediate area between the first and second terminals.

11. The electrical device of claim 1, wherein the first and second terminals are terminal posts extending from the terminal holder configured to receive power cable lugs.

12. The electrical device of claim 1, wherein the terminal holder includes a barrier wall between the first and second terminals, the second insulation layer being provided on the barrier wall.

13. The electrical device of claim 1, further comprising a first bus bar extending from the first terminal and a second bus bar extending from the second terminal, the second insulation layer being provided between the first and second bus bars.

14. The electrical device of claim 1, wherein the first insulation layer includes a thermoplastic material.

15. The electrical device of claim 1, wherein the first insulation layer includes a polyetherimide material.

16. The electrical device of claim 1, wherein the second insulation layer includes a perfluoroalkoxy material.

17. The electrical device of claim 1, wherein the second insulation layer includes a polytetrafluoroethylene material.

18. An electrical device comprising:

a terminal holder;

a plurality of terminals held by the terminal holder to define a terminal block, the plurality of terminals comprising first and second terminals;

a first insulation layer either deposited on or defined by the terminal holder between the first and second terminals; and a second insulation layer deposited on the first insulation layer, the second insulation layer being provided between the first and second terminals;

wherein the first insulation layer is a base layer comprising an aromatic polymer and the second insulation layer is a high arc tracking resistance rated layer comprising a fluoropolymer and is provided on the base layer to discourage arc tracking on the first insulation layer.

19. A method of reducing arc tracking on an electrical device comprising:

providing a first insulation layer between first and second terminals, the first insulation layer being a high temperature rated layer and comprising an aromatic polymer; and providing a second insulation layer on the first insulation layer between the first and second terminals, the second insulation layer comprising a fluoropolymer and being a high arc tracking resistance rated layer to discourage arc tracking on the first insulation layer between the first and second terminals.

* * * * *